US008302442B2

(12) United States Patent
Kiridena et al.

(10) Patent No.: US 8,302,442 B2
(45) Date of Patent: Nov. 6, 2012

(54) METHOD OF INCREMENTALLY FORMING A WORKPIECE

(75) Inventors: Vijitha Senaka Kiridena, Ann Arbor, MI (US); Zhiyong Cedric Xia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 253 days.

(21) Appl. No.: 12/845,950

(22) Filed: Jul. 29, 2010

(65) Prior Publication Data

US 2012/0024035 A1 Feb. 2, 2012

(51) Int. Cl.
*B21D 3/02* (2006.01)
*B21D 11/02* (2006.01)

(52) U.S. Cl. ..... 72/115; 72/67; 72/75; 72/122; 72/124; 72/125; 72/379.2

(58) Field of Classification Search ..... 72/67, 75, 72/82, 83, 84, 85, 112, 115, 122, 123, 124, 72/125, 126, 379.2
See application file for complete search history.

(56) References Cited

U.S. PATENT DOCUMENTS

| | | | | |
|---|---|---|---|---|
| 3,342,051 | A | 9/1967 | Leszak | |
| 3,875,382 | A | 4/1975 | Cutler | |
| 4,212,188 | A | 7/1980 | Pinson | |
| 5,103,558 | A | 4/1992 | Herrick et al. | |
| 5,392,663 | A | 2/1995 | Charles | |
| 6,151,938 | A | 11/2000 | Park et al. | |
| 6,216,508 | B1 | 4/2001 | Matsubara et al. | |
| 6,532,786 | B1 | 3/2003 | Luttgeharm | |
| 6,561,002 | B2 | 5/2003 | Okada et al. | |
| 6,971,256 | B2 | 12/2005 | Okada et al. | |
| 7,536,892 | B2 * | 5/2009 | Amino et al. | 72/305 |
| 7,971,463 | B2 * | 7/2011 | Forrest et al. | 72/67 |
| 2001/0029768 | A1 | 10/2001 | Okada et al. | |
| 2004/0187545 | A1 | 9/2004 | Okada et al. | |
| 2004/0187548 | A1 | 9/2004 | Okada et al. | |
| 2006/0272378 | A1 | 12/2006 | Amino et al. | |
| 2009/0158805 | A1 | 6/2009 | Callebaut et al. | |

FOREIGN PATENT DOCUMENTS

| | | | |
|---|---|---|---|
| EP | 1731238 | A1 | 12/2006 |
| EP | 1899089 | A2 | 3/2008 |

OTHER PUBLICATIONS

Northwestern University, AMPL Advanced Materials Processing Labratory, "Incremental Forming at Multi-scales", pp. 1-4, based on references dated between 2008 and 2009.*
U.S. Appl. No. 12/369,336, filed Feb. 11, 2009; "System and Method for Incrementally Forming a Workpiece", C. Johnson et al.
"Dieless Incremental Sheet Metal Forming Technology," Applied Plasticity Research Group, publication date unknown.
"Dieless NC Forming," www.the fabricator.com, by Taylan Altan, Jun. 12, 2003.
"Dieless Sheet Forming," Se-Prof Technology Services Ltd., printed Oct. 16, 2008, publication date unknown.

(Continued)

*Primary Examiner* — David B Jones
(74) *Attorney, Agent, or Firm* — Raymond L. Coppiellie; Brooks Kushman P.C.

(57) ABSTRACT

A method of incrementally forming a workpiece. The method includes determining a desired workpiece geometry, generating a tool path in which a feature is formed outwardly from a point that is disposed a maximum distance from a reference position, and incrementally forming the workpiece.

20 Claims, 4 Drawing Sheets

OTHER PUBLICATIONS

"Octahedral Hexapod Design Promises Enhanced Machine Performance," Ingersoll Milling Machine Company, printed Oct. 7, 2008, publication date unknown.

"A Computer Numerically Controlled Dieless Incremental Forming of a Sheet Metal," by S. Matsubara, University of Industrial Technology, Sagamihara-shi, Japan, May 25, 2001.

"Incremental Forming of Sheet Metal," by J. Cao, V. Reddy and Y. Wang, Northwestern University, publication date unknown.

"Sheet Metal Dieless Forming and its tool path generation based on STL files," by L. .Jie, M. Jianhua, and H. Shuhual; Springer London, Feb. 19, 2004.

"A review of conventional and modern single-point sheet metal forming methods," by E. Hagan and J. Jeswlet, Queen's University, Kingston, Ontario, Canada, Sep. 19, 2002.

"Investigation into a new incremental forming process using an adjustable punch set for the manufacture of a double curved sheet metal," by S. J. Yoon and D. Y. Yang; Korea Advanced Institute of Science of Technology; Taejon, Korea; Feb. 5, 2001.

"Principle and applications of multi-point matched-die forming for sheet metal," by M-Z Li-, Z-Y Cal, Z. Sui, and X-J Li, Jilin University, Changchun, People's Republic of China, Jan. 9, 2008.

* cited by examiner

METHOD OF INCREMENTALLY FORMING A WORKPIECE

BACKGROUND

Technical Field

The present invention relates to a method of incrementally forming a workpiece.

SUMMARY

In at least one embodiment a method of incrementally forming a workpiece is provided. The method includes determining a tool squeeze factor, generating a tool path based in part on the tool squeeze factor, and incrementally forming the workpiece to the desired geometry based on the tool path.

In at least one embodiment a method of incrementally forming a workpiece is provided. The method includes defining a desired workpiece geometry, determining normal vectors for the desired workpiece geometry, classifying features of the desired workpiece geometry, determining a tool path for each feature based on normal vectors associated with each feature, determining a tool squeeze factor, and incrementally forming the workpiece based on the tool path and the tool squeeze factor.

In at least one embodiment a method of incrementally forming a workpiece is provided. The method includes determining a desired workpiece geometry, classifying a feature of the desired workpiece geometry, generating a tool path for the feature in which the feature is formed outwardly from a point that is disposed a maximum distance from a reference position, and incrementally forming the workpiece to the desired geometry based on the tool path.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. In addition, any or all features from one embodiment may be combined with any other embodiment. Therefore, specific structural and functional details disclosed herein are not to be interpreted as limiting, but merely as a representative basis for the claims and/or as a representative basis for teaching one skilled in the art to variously employ the present invention.

Figure 1:
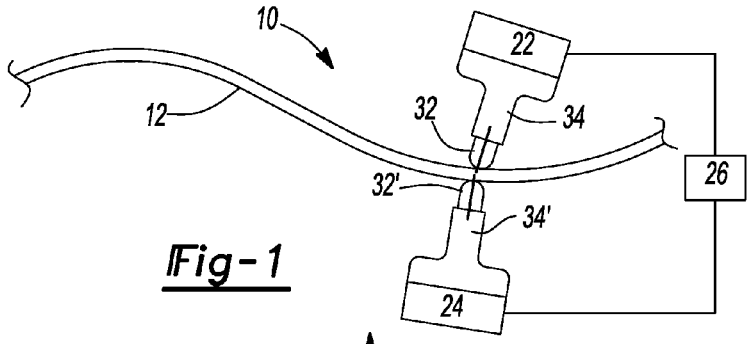
FIG. 1 is an exemplary side view of an incremental forming system for forming a workpiece.
Figure 2:
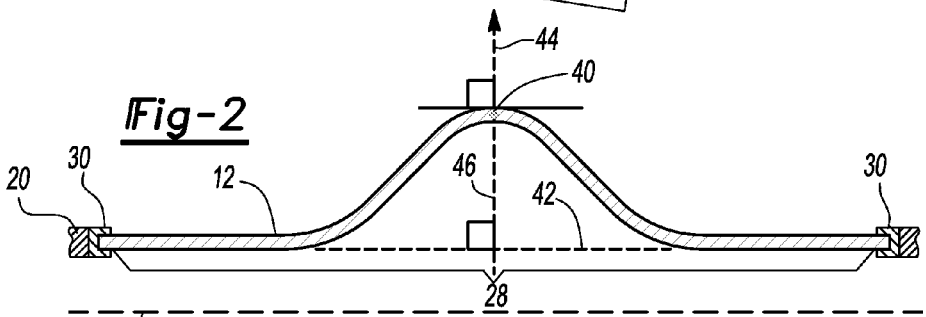
FIGS. 2 and 3 are exemplary side section views of a workpiece illustrating exemplary normal vectors.

Referring to FIGS. 1 and 2, an exemplary system 10 for incrementally forming a workpiece 12 is shown. The workpiece 12 may be made of any suitable material or materials that have desirable forming characteristics, such as a metal, metal alloy, polymeric material, or combinations thereof. In at least one embodiment, the workpiece 12 may be provided as sheet metal. The workpiece 12 may be provided in an initial configuration that is generally planar or that is at least partially preformed into a non-planar configuration in one or more embodiments.

The system 10 may be used to incrementally form a workpiece. In incremental forming, a workpiece is formed into a desired configuration by a series of small incremental deformations. The small incremental deformations may be provided by moving one or more tools along and against one or more surfaces of the workpiece. Tool movement may occur along a predetermined or programmed path. In addition, a tool movement path may be adaptively programmed in real-time based on measured feedback, such as from a sensor like a load cell. Thus, incremental forming may occur in increments as at least one tool is moved and without removing material from the workpiece. More details of such a system 10 are described in U.S. patent application Ser. No. 12/369,336, which is assigned to the assignee of the present application and is hereby incorporated by reference in its entirety. A brief summary of some components that may be provided with such a system 10 is provided below.

The system 10 may include a plurality of components that facilitate forming of the workpiece 12, such as a fixture assembly 20, a first manipulator 22, a second manipulator 24, and a controller 26.

The fixture assembly 20 may be provided to support the workpiece 12. The fixture assembly 20 may be configured as a frame that at least partially defines an opening 28. The workpiece 12 may be disposed in or at least partially cover the opening 28 when the workpiece 12 is received by the fixture assembly 20.

The fixture assembly 20 may include a plurality of clamps 30 that may be configured to engage and exert force on the workpiece 12. The clamps 30 may be provided along multiple sides of the opening 28 and may have any suitable configuration and associated actuation mechanism. For instance, the clamps 30 may be manually, pneumatically, hydraulically, or electrically actuated. Moreover, the clamps 30 may be configured to provide a fixed or adjustable amount of force upon the workpiece 12.

First and second positioning devices or manipulators 22, 24 may be provided to position first and second forming tools 32, 32'. The first and second manipulators 22, 24 may have multiple degrees of freedom, such as hexapod manipulators that may have six degrees of freedom. The manipulators 22, 24 may be configured to move an associated tool along a plurality of axes, such as axes extending in different orthogonal directions like X, Y and Z axes.

The first and second forming tools 32, 32' may be received in first and second tool holders 34, 34', respectively. The first and second tool holders 34, 34' may be disposed on a spindle and may be configured to rotate about an associated axis of rotation in one or more embodiments.

The forming tools 32, 32' may impart force to form the workpiece 12 without removing material. The forming tools 32, 32' may have any suitable geometry, including, but not limited to flat, curved, spherical, or conical shape or combinations thereof. For brevity, ball-shaped tools are depicted in the drawings and associated text.

One or more controllers 26 or control modules may be provided for controlling operation of the system 10. The controller 26 may be adapted to receive computer aided design (CAD) or coordinate data and provide computer numerical control (CNC) to form the workpiece 12 to design specifications. In addition, the controller 26 may monitor and control operation of a measurement system that may be provided to monitor dimensional characteristics of the workpiece 12 during the forming process.

During incremental forming, a workpiece is formed to a desired shape under load forces imparted to the workpiece by one or more tools. After the workpiece has been incrementally formed to a desired shape, workpiece geometry can change when forming tools are disengaged from the workpiece. As such, the workpiece may spring back to a shape that differs from the desired shape when tool load forces are no longer exerted on the workpiece. In addition, residual stresses in an incrementally formed workpiece can result in unintended deformation that may also cause dimensional inaccuracies. Dimensional inaccuracies may accumulate as a workpiece is formed. For instance, the ability to accurately form new features on the workpiece may be affected by the dimensional accuracy and stiffness of a previously formed feature. As such, dimensional inaccuracies of a previously formed feature may affect or increase the dimensional inaccuracy and/or unwanted plastic deformation of subsequently formed features.

To help address one or more of the issues described above, a method of incremental forming as described below may be used to form a workpiece. The method may employ forming tools that are disposed on opposite sides of a workpiece. Features may be formed on the workpiece in a relative manner in which one or more features may be formed separately or sequentially. In addition, each feature may be formed outwardly from a point or region of the feature that is disposed at (1) a maximum distance from a reference plane or reference position and/or (2) where a normal vector extending from a surface of the workpiece is disposed substantially parallel to a normal vector or normal axis that extends from the reference plane or reference position.

Figure 3:
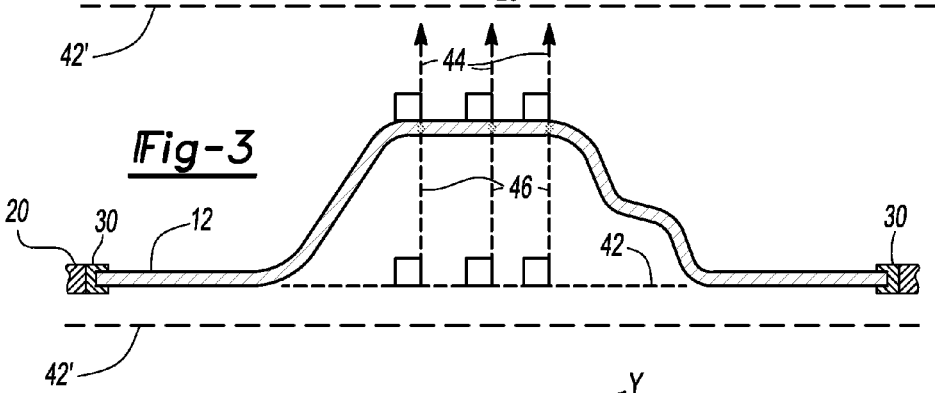

Referring to FIGS. 2 and 3, two examples of incrementally formed workpieces are shown that depict points or regions from which outward formation may occur.

In FIG. 2, the workpiece 12 is shown with a point 40 disposed at a maximum distance from an exemplary reference plane 42. A normal vector 44 is shown that extends from a surface of the workpiece 12 at point 40. The normal vector 44 is oriented substantially parallel to a normal vector or normal axis 46 that extends from a reference plane 42. As such, the workpiece 12 may be formed outwardly from normal axis 46 to arrive at the desired workpiece configuration shown.

In FIG. 3, a plurality of normal vectors 44 are shown that extend from a region of the workpiece 12 that are oriented substantially parallel to normal vectors or normal axes 46 that extend from reference plane 42. As such, the workpiece 12 may be formed outwardly from any of the normal axes 46 or similar positions to arrive at the desired workpiece configuration shown.

In FIGS. 2 and 3, the reference plane 42 is depicted as extending through at least a portion of the workpiece 12. In one or more embodiments, the initial configuration of the workpiece 12 may define a reference plane or reference position. For instance, for a workpiece 12 having a substantially planar initial configuration a reference plane 42 may be a plane in which the workpiece 12 is disposed. For a non-planar workpiece, a reference position may be a surface of the workpiece 12 that has not been preformed prior to incremental forming. In addition, a reference configuration may be a mathematically defined surface or datum that does not intersect the workpiece 12. For example, such a reference surface may be a plane or surface that is disposed parallel to but spaced apart from at least a portion of the workpiece 12 when in an initial configuration, such as reference plane 42'.

Referring to FIGS. 4-7, a side view of an exemplary workpiece 12 undergoing incremental forming is shown. These figures illustrate incremental forming of a feature on the workpiece 12 outwardly from a point or region that is disposed at a maximum distance from a reference plane or reference position. It is to be understood that these figures as well as any associated method steps may be employed to incrementally form workpiece features that may have various geometries that may or may not be symmetric with respect to an axis.

Figure 4:
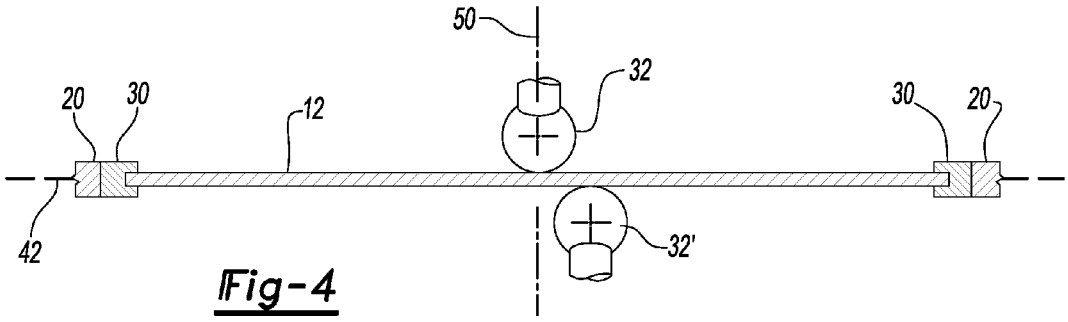
FIGS. 4-7 are exemplary side section views of a workpiece being incrementally formed.

Referring to FIG. 4, the workpiece 12 is shown in an initial configuration. The initial configuration of the workpiece 12 may be the configuration or shape of the workpiece 12 prior to incremental forming. The initial configuration may be substantially planar as shown. Alternatively, the workpiece 12 may be preformed or provided such that at least a portion of the workpiece 12 is non-planar prior to incremental forming.

Incremental forming may begin at axis 50. For illustration purposes, axis 50 coincides with a point disposed at a maximum distance from reference plane 42 in a direction extending downward or toward the bottom of the page as can be seen by comparing the initial workpiece position shown in FIG. 4 to the final workpiece configuration shown in FIG. 7. The feature that is incrementally formed may or may not be symmetric with respect to axis 50.

Figure 5:
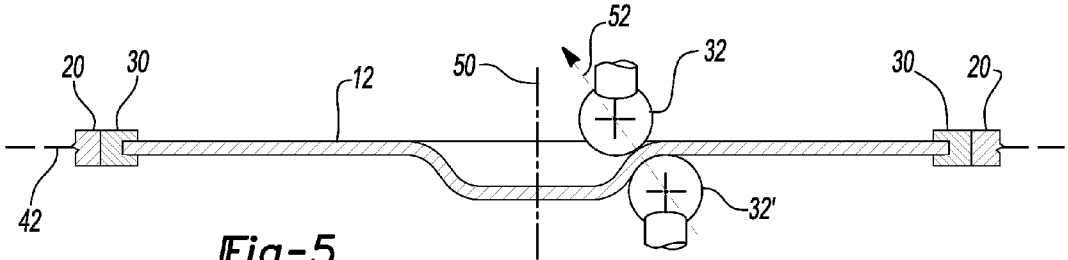
Figure 6:
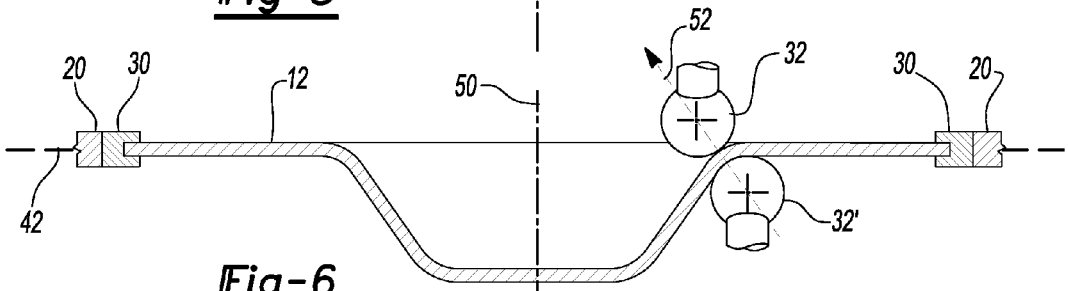

Referring to FIGS. 5 and 6, the workpiece 12 is shown after being partially incrementally formed outward from axis 50. During incremental forming, the forming tools 32, 32' may move along a spiral path in either a clockwise or counterclockwise direction. The spiral path may be based on normal vectors 52 as will be discussed in more detail below. In addition, the normal vectors 52 may extend substantially through the center of each incremental forming tool 32, 32' in one or more embodiments. As shown, the forming tools 32, 32' may follow a path that moves them further from the axis 50 as illustrated by comparing FIGS. 5 and 6. In FIGS. 5 and 6, the feature being formed has a concave configuration.

Figure 7:
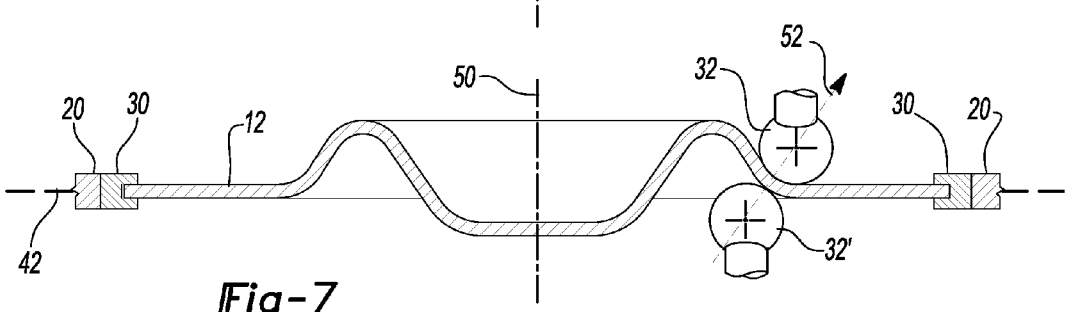

FIG. 7 illustrates that the workpiece 12 may be provided with a combination of concave and convex surfaces during a forming sequence. In FIG. 7, the workpiece 12 is shown after a convex surface has been formed outwardly from the axis 50 and the concave portion of the feature. Forming of the convex surface may draw the concave portion up toward the reference plane 42. Although the concave portion may move relative to the reference plane 42 when the convex surface is formed, the axis 50 remains disposed at a point or region of maximum distance from a reference plane in a downward direction in the perspective shown.

Figure 8:
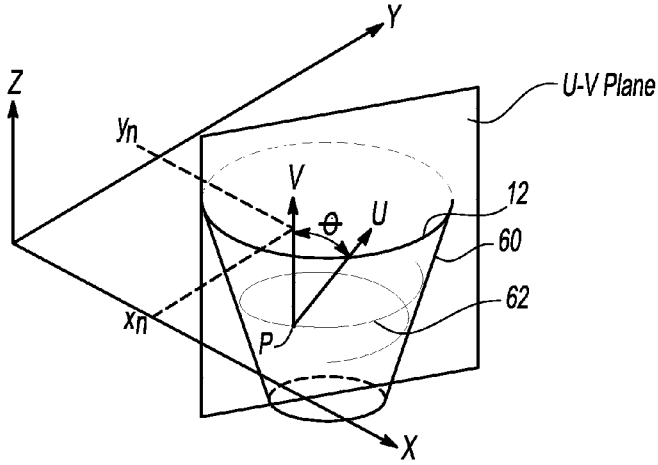
FIG. 8 is a perspective view of an exemplary tool path for incrementally forming a workpiece.
Figure 9:
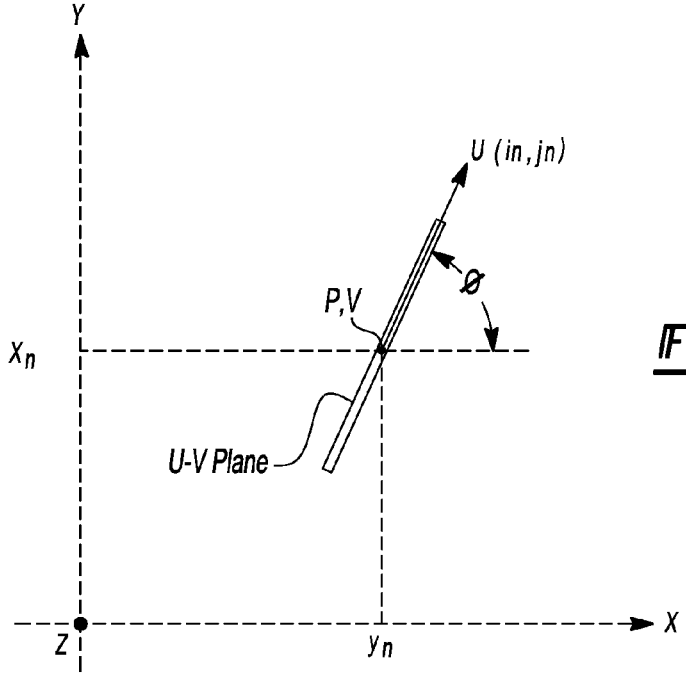
FIG. 9 is a top view of FIG. 8 showing a U-V plane.
Figure 10:
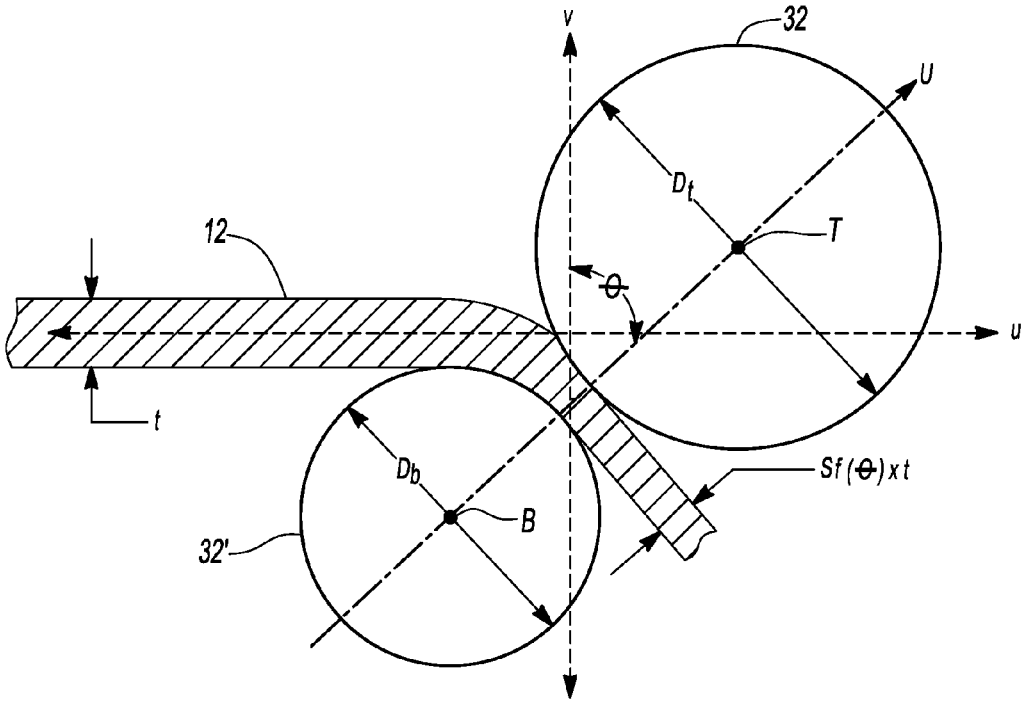
FIG. 10 is a side section view of the workpiece in the U-V plane of FIG. 8.

Referring to FIGS. 8-10, various views of an exemplary workpiece are shown undergoing incremental forming. These views are provided to show geometric and mathematical features that may be employed to determine incremental forming parameters. For clarity, only a portion of the workpiece is shown in these figures. As such, the workpiece may include more features that are incrementally formed and that have different configurations that that depicted.

In FIG. 8, the workpiece 12 is shown with a feature 60 and an exemplary tool path 62 for forming the feature 60. Point P is a representative point on the tool path 62. The geometric features and coordinates described below with respect to point P are exemplary and may be calculated or determined for other points on the tool path. Similarly, while the feature 60 is shown with a tapered conical configuration, the feature 60 is merely exemplary and may be provided with another configuration that may not be at least partially conical.

Point P has coordinates of $(x_n, y_n, z_n)$ in an XYZ coordinate system. In addition, point P has a normal vector U with respect to a surface of the workpiece 12. Normal vector U is disposed in a plane that contains normal vector U and axis vector V. Axis vector V is disposed parallel to the Z axis and extends from point P. As such, the plane in which normal vector U and axis vector V are disposed is referred to as a U-V plane, which is represented by the plane labeled "U-V Plane" in FIG. 8. Normal vector U has coordinates of $(i_n, j_n, k_n)$ in the U-V plane. The angle between normal vector U and axis vector V is θ, which may be mathematically defined by formula (1).

$$\theta=\cos^{-1}(k_n) \tag{1}$$

where:

$k_n$ is the k component of the normal vector U

FIG. 9 is a top view of the U-V plane shown in FIG. 8. For clarity, the workpiece and tool path are not shown and the U-V plane is shown having a thickness so as to better show normal vector U. From the perspective shown, axis V coincides with point P. The angle between normal vector U or the U-V plane and axis X (or a line extending parallel to axis X through point P) is Ø, which may be mathematically defined with formula (2).

$$\varnothing=\cos^{-1}(i_n/\sqrt{(i_n^2+j_n^2)}) \tag{2}$$

where:

$i_n$ is the i component of the normal vector U $j_n$ is the j component of the normal vector U Referring to FIG. 10, a side section view of the workpiece 12 and forming tools 32, 32' are shown in the U-V plane. The U-V plane can be considered the plane in which FIG. 10 is illustrated. For clarity, axes in the U-V plane are shown in lower case letters so as not to be confused with vectors U and V.

The workpiece 12 has a nominal or pre-forming thickness designated t. The thickness of the workpiece 12 after forming is designated by formula (3).

$$Sf(\theta)*t \tag{3}$$

where:

Sf is a squeeze factor,

θ is the angle from formula (1), and t is the nominal thickness of the workpiece The squeeze factor may be a numerical value indicative of a compressive force exerted by the tools 32, 32' upon the workpiece 12 during incremental forming. Determination of the squeeze factor is discussed in more detail below.

The upper or top tool 32 has a center T and a diameter designated $D_t$. The lower or bottom tool has a center B and a diameter designated $D_b$. The normal vector U is shown passing through the centers T and B of the top and bottom tools 32, 32'.

The coordinates of the center T of the top tool 32 in the U-V plane may be determined by formulas (4) and (5).

$$u_t=0.5*[t*Sf(\theta)+D_t]*\sin(\theta) \tag{4}$$

where:

t is the nominal workpiece thickness prior to incremental forming,

Sf is the squeeze factor,

θ is the angle from formula (1), and $D_t$ is the diameter of the top tool $$v_t=0.5*(D_b+D_t)*\cos(\theta)+t*Sf(\theta)*\cos(\theta)-0.5*(D_b+D_t+t) \tag{5}$$

where:

$D_b$ is the diameter of the bottom tool, $D_t$ is the diameter of the top tool, θ is the angle from formula (1), t is the nominal workpiece thickness prior to incremental forming, and Sf is the squeeze factor The coordinates of the center B of the bottom tool 32' in the U-V plane may be determined by formulas (6) and (7).

$$u_b=-0.5*[t*Sf(\theta)+D_b]*\sin(\theta) \tag{6}$$

where:

t is the nominal workpiece thickness prior to incremental forming,

Sf is the squeeze factor,

θ is the angle from formula (1), and $D_b$ is the diameter of the bottom tool $$v_b=-0.5*t \tag{7}$$

where:

t is the nominal workpiece thickness prior to incremental forming

Figure 11:
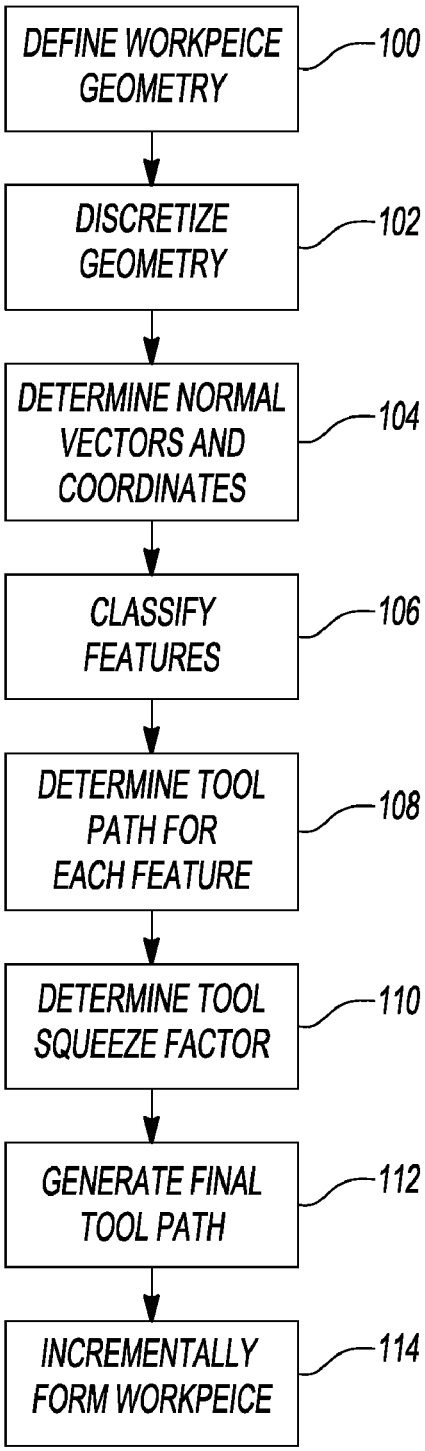
FIG. 11 is a flowchart of a method of incrementally forming a workpiece.

Referring to FIG. 11, a flowchart of a method of incrementally forming a workpiece is shown. This method may incorporate the attributes previously described to form a workpiece to help reduce dimensional inaccuracies that may be associated with spring back and/or plastic or permanent deformation.

At 100, the method may begin by defining the desired geometry or configuration of the workpiece. The desired configuration may be defined in a virtual or (CAD) environment in a manner known by those skilled in the art.

At 102, the desired workpiece geometry may be discretized or analyzed to determine coordinates having the same coordinates along a predetermined axis, such as the Z axis. As such, one or more sets of points or coordinates may be defined that have the same distance from a reference position or a reference plane. Such points or coordinates may define contour lines that represent contiguous points having the same distance from a reference position or reference plane, similar to contour lines that show points having the same altitude on a topographic map. As such, points or contour lines may be compiled that have the same or constant Z axis levels. The reference position may be an initial position of the workpiece 12 or another datum reference as previously discussed.

At 104, normal vectors are calculated for the coordinates. Determination of such normal vectors may be mathematically determined in a manner known by those skilled in the art. For instance, the coordinates of each data point may be extracted from CAD data and normal vectors may then be calculated based on the coordinates.

At 106, features to be incrementally formed on the workpiece are classified. Features may be classified as being concave or convex. Classification may be made with respect to a reference position or reference plane.

At 108, a tool path is determined for one or more features. The tool path may include a tool path for each incremental forming tool. The tool path that is defined may be a generally spiral tool path that may be based on the discretized coordinates and associated normal vectors for each feature. For instance, the tool path may be created for a feature by connecting points or contour lines that have the same or constant Z axis levels and connecting a tool path for once constant Z axis level to an adjacent Z axis level.

At 110, a tool squeeze factor may be determined. The squeeze factor may be a constant or variable value and may be based on the thickness of the workpiece material, properties of the material from which the workpiece is made, and the geometry of the incremental forming tools. A set or array of squeeze factors may be determined in advance and stored for subsequent use. For instance, a lookup table may be populated with various squeeze factor values that may be determined by experimentation. Experimentation may include employing an iterative process in which an initial squeeze factor and tool apex angle is selected and used to form a workpiece. The workpiece may be then measured to determine how closely it conforms to a desired shape. Then the squeeze factor and/or apex angle may be modified and another workpiece may be formed and measured. The squeeze factor associated with the workpiece that best matches the desired shape may be selected to populate the lookup table.

At 112, a final tool path may be generated. The final tool path may be a final tool path for one or more features. The tool path may be expressed in terms of an orthogonal coordinate system, such as X, Y and Z axes, or any coordinate systems that is compatible with the incremental forming equipment. For instance, coordinates that are expressed in terms of another coordinate system (e.g., a U-V plane coordinate system) may be converted to a another coordinate system compatible with the equipment and processing technology employed. In addition, the order in which features are incrementally formed may be determined. More specifically, if there are multiple workpiece features that are separated from each other, such as by a substantially flat surface or other surface that is not designated for forming by a common spiral tool path, these features may be organized and sequenced in the final tool forming path. Sequencing may be based many factors, such as proximity (e.g., shortest distance between the final tool position for the first feature that is incrementally formed and the next closest feature) or tool path length (e.g., forming features having successively longer or shorter tool path lengths).

For example, U-V plane coordinates for the top tool 32 may be converted to X, Y and Z axis coordinates using formulas (8) through (10).

$$x_t=x_n+u_t*\cos(\theta) \tag{8}$$

$$y_t=y_n+u_t*\sin(\theta) \tag{9}$$

$$z_t=v_t \tag{10}$$

where:

$x_n$ is the x axis coordinate for the normal vector coordinate $y_n$ is the y axis coordinate for the normal vector coordinate $u_t$ is a value from formula 4

$v_t$ is a value from formula 5

U-V plane coordinates for the bottom tool 32' may be converted to X, Y and Z axis coordinates using formulas (11) through (13).

$$x_b=x_n+u_b*\cos(\theta) \tag{11}$$

$$y_b=y_n+u_b*\sin(\theta) \tag{12}$$

$$z_b=v_b \tag{13}$$

where:

$x_n$ is the x axis coordinate for the normal vector coordinate $y_n$ is the y axis coordinate for the normal vector coordinate $u_b$ is a value from formula 6

$v_b$ is a value from formula 7

In addition, the orientation of the normal axis for the top tool and bottom tools can be set in opposing directions. For example, the axis orientation for the top tool may be established as $(i_t, j_t, k_t)=(0, 0, 1)$ and the axis orientation for the bottom tool may be established as $(i_b, j_b, k_b)=(0, 0, -1)$.

At 114, the workpiece is incrementally formed by executing the final tool path. As such, the forming tools may be moved along the tool path employing an appropriate squeeze factor to incrementally form the workpiece to the desired configuration. The present invention also contemplates that a squeeze factor may or may not be employed along the entire tool path. For instance, there may be portions of the tool path during which it may be desirable to provide a gap between the workpiece and at least one incremental forming tool. In such regions, the squeeze factor exerted upon the workpiece may effectively be zero. In addition, there may be portions of the tool path during which tools are disengaged from the workpiece to traverse to another position at which incremental forming may continue. As such, the tool path could be further refined or defined as primarily being a path of tool movement where incremental forming occurs.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of incrementally forming a workpiece, comprising:

determining a tool squeeze factor indicative of a compressive force exerted upon the workpiece based on a nominal thickness of the workpiece prior to incremental forming, material properties of a material from which the workpiece is made, and geometry of first and second tools that incrementally form the workpiece;

generating a tool path based in part on the tool squeeze factor; and incrementally forming the workpiece to a desired geometry based on the tool path.

2. The method of claim 1 wherein the tool path is configured as a spiral tool path that forms at least one feature of the workpiece outwardly from a point of the feature that is disposed a maximum distance from a reference plane.

3. The method of claim 1 wherein the tool path is configured as a spiral tool path that forms at least one feature of the workpiece outwardly from a point where a normal vector extending from a surface of the feature is disposed substantially parallel to an axis that extends substantially perpendicular to a reference plane.

4. The method of claim 3 wherein the reference plane is defined by an initial configuration of the workpiece prior to incrementally forming the workpiece.

5. The method of claim 1 wherein the tool squeeze factor is determined by an iterative process in which the tool squeeze factor and/or a tool apex angle are modified.

6. The method of claim 1 wherein the tool path is based on normal vectors relative to a surface of the workpiece.

7. The method of claim 6 wherein the step of incrementally forming the workpiece includes positioning first and second tools against opposite surfaces of the workpiece such that the normal vector extends through the first and second tools.

8. The method of claim 7 wherein the normal vector extends through a center of the first tool and a center of the second tool.

9. The method of claim 8 wherein the center of the first tool and the center of the second tool are disposed in a plane that includes the normal vector and an orthogonal axis.

10. A method of incrementally forming a workpiece, comprising:

defining a desired workpiece geometry;

determining normal vectors for the desired workpiece geometry;

classifying features of the desired workpiece geometry;

determining a tool path for each feature based on normal vectors associated with each feature;

determining a tool squeeze factor; and incrementally forming the workpiece based on the tool path and the tool squeeze factor.

11. The method of claim 10 wherein the step of determining the tool squeeze factor further comprises generating a final tool path and converting the final tool path from a coordinate system based on the normal vectors to an XYZ coordinate system.

12. The method of claim 10 wherein the step of determining normal vectors includes determining a set of coordinates for the desired workpiece geometry and determining a normal vector for each member of the set of coordinates.

13. The method of claim 10 wherein the step of defining the desired workpiece geometry includes discretizing the desired workpiece geometry into sets of coordinates disposed along constant contour lines disposed a same distance from a reference plane.

14. The method of claim 13 wherein the reference plane extends at least partially through the workpiece before the workpiece is formed.

15. The method of claim 13 wherein the step of classifying features of the desired workpiece geometry further comprises converting the sets of coordinates disposed along constant contour lines into a spiral tool path.

16. The method of claim 10 wherein the step of incrementally forming the workpiece includes moving first and second forming tools along opposing surfaces of the workpiece along the tool path.

17. The method of claim 10 wherein classified features are formed separately.

18. A method of incrementally forming a workpiece, comprising:

determining a desired workpiece geometry;

classifying a feature of the desired workpiece geometry;

generating a tool path for the feature in which the feature is formed outwardly from a point that is disposed a maximum distance from a reference position; and incrementally forming the workpiece to the desired geometry based on the tool path.

19. The method of claim 18 wherein the feature is formed outwardly from a point where a normal vector extending from a surface of the workpiece is disposed substantially parallel to a normal vector of the reference position.

20. The method of claim 18 wherein the tool path is a spiral tool path based on constant Z axis levels of the desired workpiece geometry.

* * * * *